United States Patent [19]

Wolter

[11] 4,276,453

[45] Jun. 30, 1981

[54] ELECTRIC SWITCHING DEVICE ON A ROTARY CYLINDER LOCK

[75] Inventor: Heinz Wolter, Kürten, Fed. Rep. of Germany

[73] Assignee: DOM-Sicherheitstechnik GmbH & Co. KG, Brühl, Fed. Rep. of Germany

[21] Appl. No.: 103,794

[22] Filed: Dec. 14, 1979

[30] Foreign Application Priority Data

Dec. 16, 1978 [DE] Fed. Rep. of Germany ..... 2854424

[51] Int. Cl.[3] ..... H01H 27/00; H01H 27/06

[52] U.S. Cl. ..... 200/44; 200/6 BA; 200/6 BB; 200/153 LB

[58] Field of Search ..... 200/44, 1 B, 1 A, 5 A, 200/5 B, 5 C, 6 B, 6 BA, 12, 13, 153 LB

[56] References Cited

U.S. PATENT DOCUMENTS

| | | | |
|---|---|---|---|
| 3,359,392 | 12/1967 | Heath | 200/6 BA |
| 3,590,176 | 6/1971 | Laserson | 200/6 BB |
| 3,705,507 | 12/1972 | Sanders et al. | 200/44 |
| 3,801,755 | 4/1974 | Schlage | 200/44 |
| 3,806,675 | 4/1974 | Krom et al. | 200/44 |

*Primary Examiner*—Willis Little

*Attorney, Agent, or Firm*—Martin A. Farber

[57] ABSTRACT

An electric switching device on a rotary cylinder lock, particularly for gasoline pumps, with core pins which are controlled by the key, the stroke of the core pins bringing contact lugs in contact position to counter-contact surfaces. The core pin acts on a transmission lever, the free end of which lever, which end forms the contact lug, slides over a row of adjacent contact surfaces.

16 Claims, 9 Drawing Figures

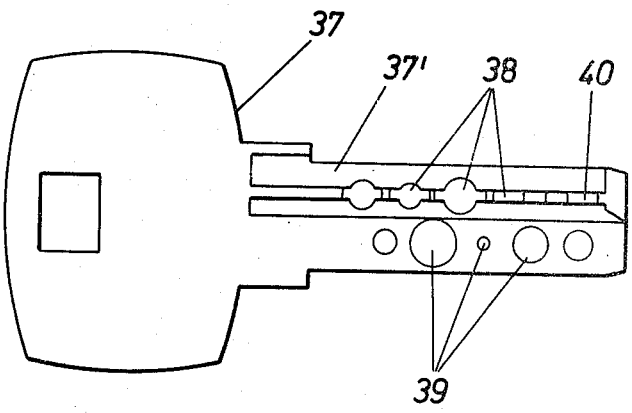
FIG. 7
FIG. 8
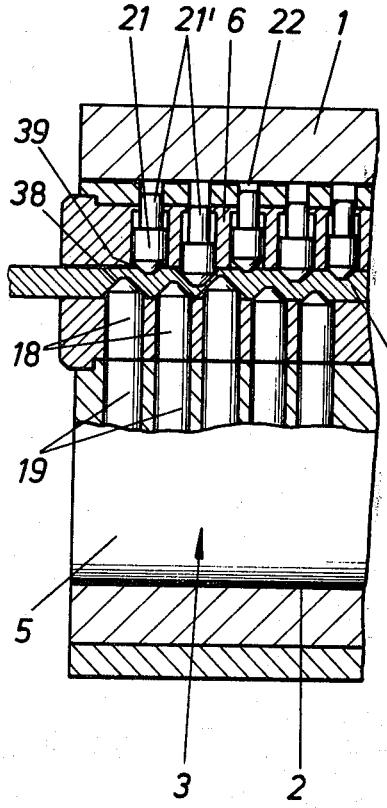
FIG. 9
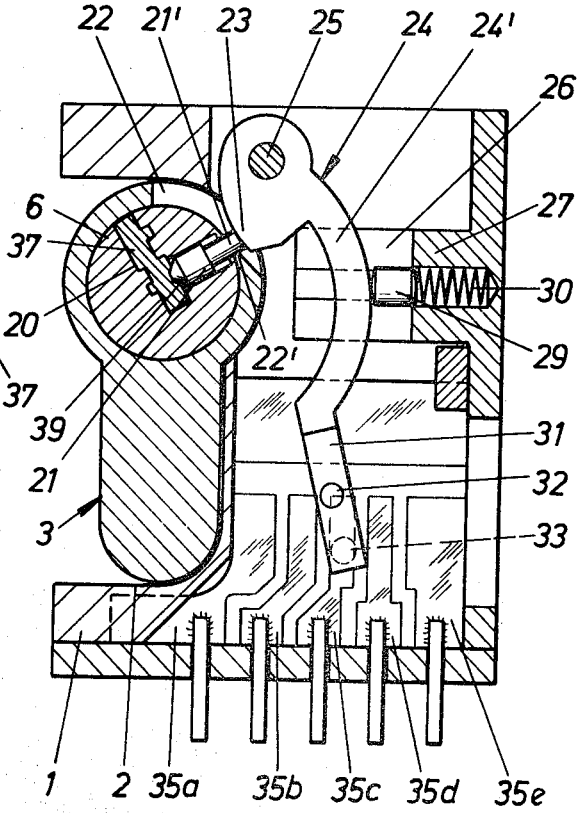

ELECTRIC SWITCHING DEVICE ON A ROTARY CYLINDER LOCK

The invention relates to an electric switching device on a rotary cylinder lock, particularly for gasoline pumps, with core pins, which core pins are controlled by the key, the stroke of the core pins bringing contact lugs in contact position to counter-contact surfaces.

With a known formation of this type a number of the core pins which lie in one plane cooperate with tripping pins, which tripping pins are arranged intersecting the core pins and guided in the cylinder housing (German Pat. No. 1 553 479). In the rotated position of the cylinder core, that is, the switching position, the tripping pins are aligned with the core pins which are coordinated to them. A control of the contact lugs then takes place depending upon the respective displacement of the core pins. This formation is disadvantageous in that because of the switching device which operates according to the on-off principle, the attainable combinations are small in proportion to the number of the core pins that control the contact lugs. The increase of the combinations is possible only by lengthening the rotary cylinder in order to be able to accommodate more core pins.

The object of the invention is based on the task of developing an electrical switching device on a rotary cylinder lock of the type discussed such that with a short length for the rotary cylinder lock and even with a small number of core pins controlling the contact lugs, an increased number of combinations is achieved.

This task is solved in the manner that the core pin acts on a transmission lever, the free end of which, which end forms the contact lug, slides over a row of contact surfaces which are adjacent to each other.

As a result of such kind of a development an electric switching arrangement according to the generic type is provided on a rotary cylinder lock, which switching arrangement is characterized by a large number of combinations, with the rotary cylinder lock having a short length and even with a small number of core pins controlling the contact lugs. By means of the transmission lever the stroke of each core pin experiences a spread or expansion so that even with one core pin and one transmission lever which cooperates with the core pin, several switching positions can be surely brought about with achievement of a true coding. For example, even with five core pins, and, five counter-contact surfaces which lie next to one another in a row $5^5$ equaling 3,125 combinations are altogether achieved. As opposed to the known formation, therefore, an increased number of customer keys exists for the rotary cylinder lock. Along with this the advantage is also achieved that as a result of the relatively short length of the rotary cylinder lock, a key is available which does not exceed the length of customary flat keys.

An advantageous development is that the core pin acts on the transmission lever only in the vicinity of the end of the rotation of the core.

The insertion and withdrawal of the key therefore can be performed easier since then the transmission lever does not produce a disturbing effect upon the core pins. Also the transmission levers are switched only when the key is intentionally turned with the cylinder core. It is not possible to sense or feel the transmission levers from the outside without authorization.

Additionally it proves advantageous for the free end of the transmission lever to have two contacts, of which one faces toward the counter-contact surfaces which are adjacent to each other, and the other slides over a continuous contact surface.

Advantageously for this, respectively each lever is disposed in the gap between the contact plates, which contact plates are combined together into a block, and the contacts point in opposite directions.

Control advantages are provided in the manner that the core pins are formed as springless pins provided in addition to the tumbler pins, the ends of the springless pins (which ends project into the cylinder housing) projecting into openings in the housing wall, which openings extend in the direction of rotation. These openings at the same time can serve for limiting the angle of rotation of the cylinder core in the manner that the edges of the openings cooperate with the ends of the core pins which face toward them.

In this it proves to be advantageous that the transmission lever with a projecting cam projects into the opening. In this manner the transmission lever receives guidance simultaneously by means of or through the opening. Also it is guaranteed that the core pin which is coordinated with each transmission lever comes surely in contact with the transmission lever upon a locking rotation of the cylinder core.

The sure interaction of the transmission levers with the core pins which are coordinated to the latter is accomplished in the manner that the transmission lever is acted upon by the core pins against spring biasing.

Finally it is of further advantage for the biasing springs to be arranged in individual channels of the switch housing.

The construction parts which are coordinated to the transmission lever therefore can be stably constructed in relation to the size of the entire electrical switching arrangement, which offers an operation free of disturbance.

With the above and other objects and advantages in view, the present invention will become more clearly understood in connection with the detailed description of a preferred embodiment, when considered with the accompanying drawings, of which:

Figure 3:
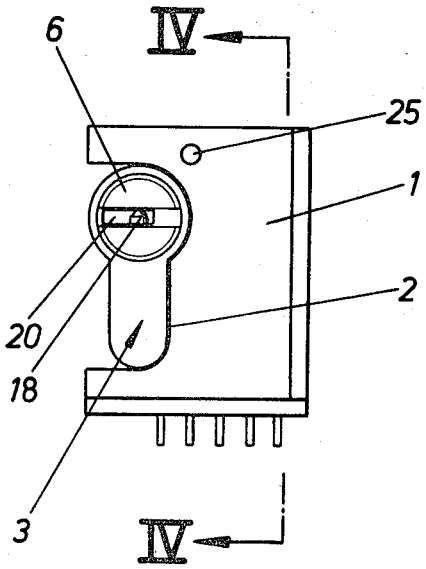
FIG. 3 is the front view of the electrical switching arrangement.
Figure 4:
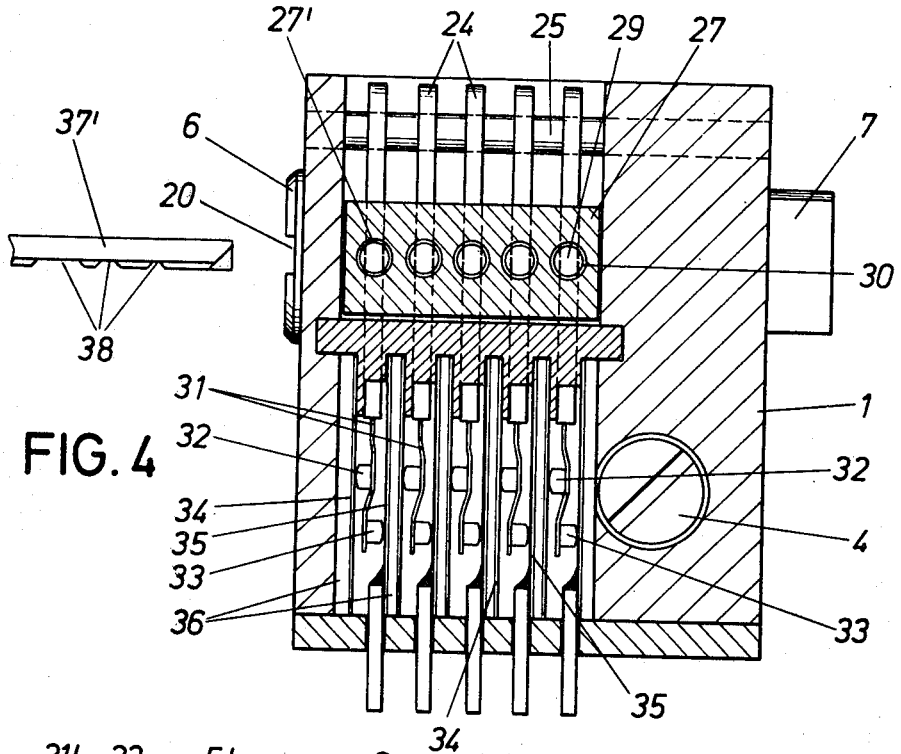
Figure 5:
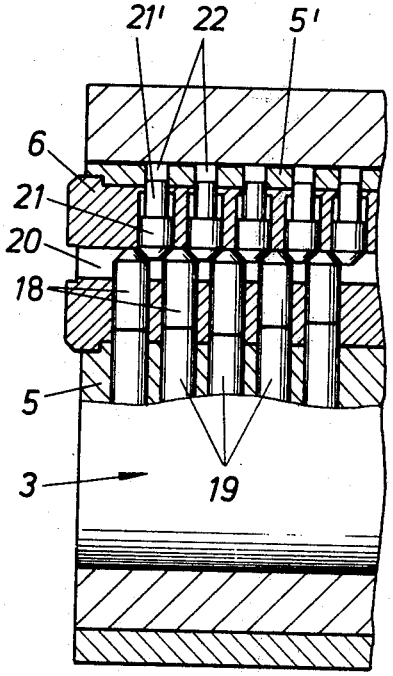
Figure 6:
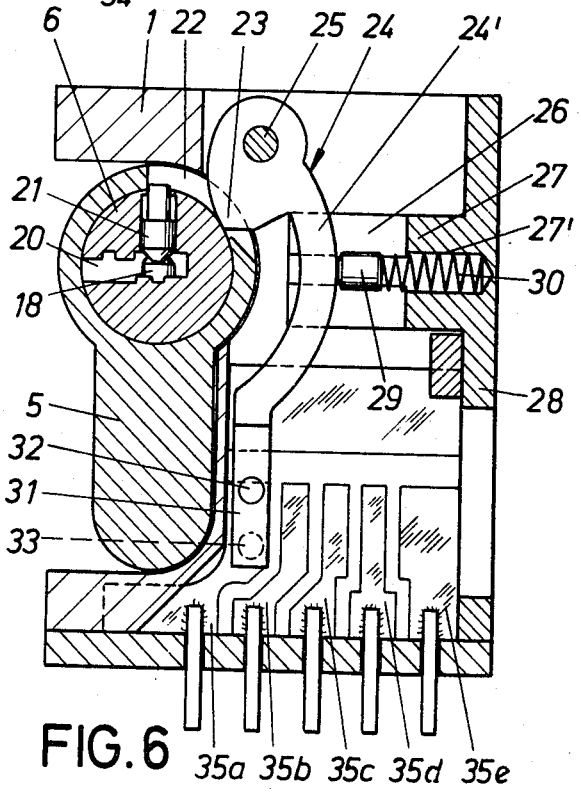

FIG. 4 on a larger scale is the section according to the line IV—IV in FIG. 3, FIG. 5 is a partial, central longitudinal section through the rotary cylinder lock with the key not inserted, FIG. 6 is a cross section through the rotary cylinder lock in the plane of a transmitting lever, FIG. 7 is a top plan view of the key which is formed as reversible flat key, FIG. 8 is an illustration corresponding to FIG. 5 in which the key is inserted, and FIG. 9 is an illustration corresponding to FIG. 6, however with the cylinder core brought into the switching position by the key and with the transmission lever displaced thereby by the core pin.

A switch housing marked 1 receives a rotary cylinder lock 3 in a recess 2, the latter being open toward one side. The rotary cylinder lock 3 is formed as a semi-cylinder profile and by means of the screw 4 is fixed in the switch housing 1.

Figure 1:
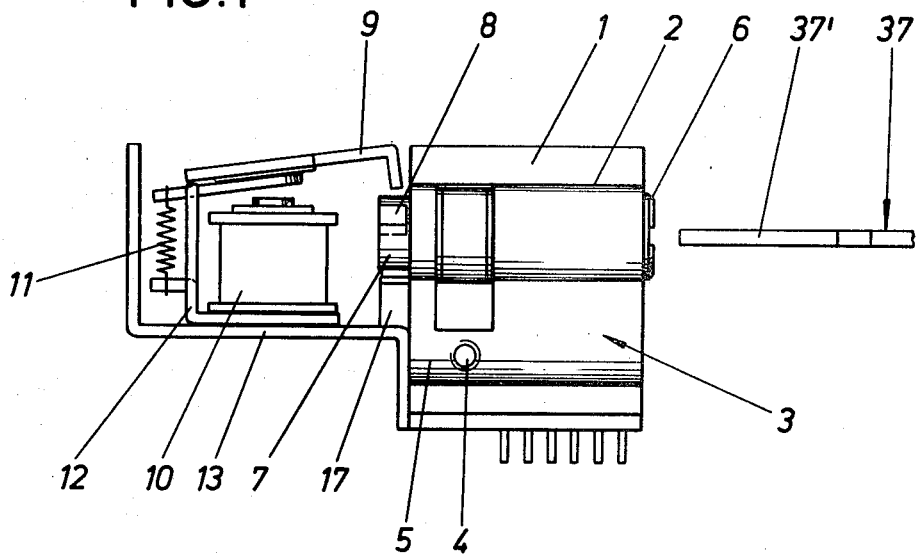
FIG. 1 is a side view of the electric switching arrangement on a rotary cylinder lock with a coordinated key.
Figure 2:
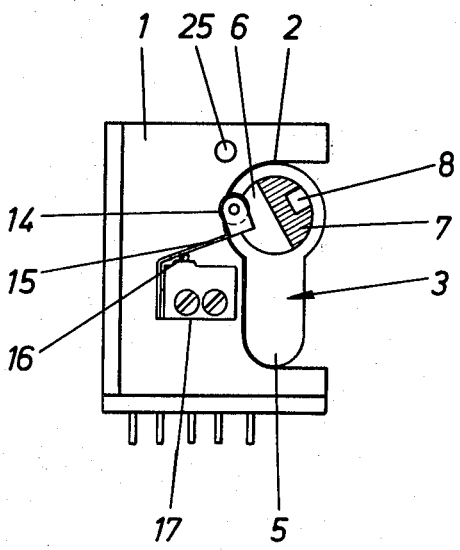
FIG. 2 is a rear view of the switching device with the magnet coil or solenoid omitted.

The length of the rotary cylinder lock 3 corresponds to the length of the switch housing 1 (cf. FIG. 1). In its cylindrical section the cylinder housing 5 supports the cylinder core 6, the rear end of which is provided with a trip or contact cam 7, the contact cam 7 projecting over or beyond the rotary cylinder housing. A radially aligned groove 8 of the contact cam 7 cooperates with a locking lever or pawl 9, which locking lever 9 in its turn by means of a magnetic coil or solenoid 10 is displaceable against the force of the spring 11. The support 12, which holds the solenoid 10 and which mounts the pawl 9, in turn is seated on a console 13, which console 13 is attached to the rear side of the switch housing 1.

During its locking rotation the contact cam 7 actuates a switch pulley or sprocket wheel 14 of a resilient lever 15, the latter in turn acting upon the key or contact 16 of a switch 17.

On the one side the cylinder core 6 receives the core tumbler pins 18, one end of which core tumbler pins 18 lie next to one another in a row and which cooperate with the housing tumbler pins 19, the latter being guided in the cylinder housing 5. Compression springs (not shown) are coordinated to housing pins 19, by means of which compression springs the housing pins 19 press the core tumbler pins 18 into the key channel 20 of the cylinder core.

The core pins 21, which likewise are disposed in a row next to one another, extend in opposite position relative to the core tumbler pins 18. The core pins 21, however, are staggered or offset relative to the core pins 18.

The core tumbler pins 18 as well as the pins 21 have at their ends which point toward the key channel a frusto conically-shaped head. By this the upper core pins 21 are supported against the core pins 18, which pins 18 are pressed against one key channel wall by the compression springs (not shown). The outer ends 21' of the core pins 21 are cross-sectionally narrowed and project into openings 22 in the housing wall 5', which openings extend in the direction of rotation. According to the embodiment example each opening 22 extends over an angle of approximately 60 degrees.

A projecting cam 23 of a transmission lever 24 (which lever 24 is formed as a one-armed lever) projects into each opening 22. A pivot pin 25 serves for supporting the transmission levers, the pin 25 extending parallel to the axis of rotation of the cylinder core 6. On the other side of the cam 23 each transmission lever transfers or continues into a curved section 24'. Each section 24' is guided in a longitudinal slot 26 of a projection 27 of a wall 28, which wall 28 closes the switch housing 1. Each curved section 24' is acted on by a pressure pin 29, on which pressure pin 29 there acts a biasing spring 30, the biasing spring 30 being accommodated in a channel 27' of the projection 27. With an unturned cylinder core 6, the cam 23 of the transmission lever 24 is supported against the outer surface of the cylinder core 6 such that the contact lug 31, which is attached to the free end of the curved section 24', extends approximately parallel to the radially projecting flange of the cylinder housing 5 (cf. FIG. 6).

Each contact lug 31 is equipped with two contacts 32 and 33 which lie opposite to each other. One contact 32 slides over a continuous extending contact surface 34, whereas the other contact 33 is turned toward the contact surfaces 35*a*, 35*b*, 35*c*, 35*d* and 35*e* which are disposed adjacent to each other. In the withdrawn position of the key, the contact 33 rests against the counter-contact surface 35*a*.

The counter-contact surfaces which lie next to each another in a row, as well as the continuous contact surfaces are located on contact plates 36, which contact plates 36 are combined together into a block such that the transmitting levers 24 each respectively project into the gap between the contact plates.

As can be seen in FIG. 4, the contact lugs 31 are slightly bent and are made of resilient or elastic material, so that their contracts 32, 33 are biased to act on the contact surfaces which face them.

The key 37 associated with the rotary cylinder lock 3 is formed as a flat key. In order to be able to use it as a reversible key, the key shank 37 on each wide surface of the key has two rows of recesses 38 and 39, which are adjacent to each other. The recesses 38, which extend in a projecting rib 40 of the flat key 37 act on the core tumbler pins 18, whereas the other recesses 39 displace the additional core pins 21.

With an inserted key 37, by means of the recesses 38, the core tumbler pins 18 are displaced in such a manner that the separation line between the core tumbler pins 18 and the housing tumbler pins 19 lies at a level with the outer surface of the rotary cylinder core 6, so that the latter can be rotated. The recesses 39, which are located on the other wide face of the key and which lie opposite to the recesses 38 and which are staggered, act on the additional core pins 21 with different strokes.

Then if the locking rotation of the cylinder core 6 takes place, the cams 23 (which cams project into the openings 22) of the transmission levers 24 are acted on by means of the ends 21' of the core pins 21, and thereby the respective transmission levers 24 are pivoted various distances. Depending upon the size of the stroke, one contact 33 comes into contact position with one counter-contact surface of the counter-contact surfaces which are adjacent to each other. As shown in FIG. 9, the core pins 21 act on the cams of the transmission levers 24 only in the vicinity of the end of the rotation of the core.

At the same time the additional core pins 21 also have the purpose of limiting the locking rotation in the manner that the ends 21' of the core pins 21, which ends 21' project into the openings 22, act on one edge 22' of the opening 22.

If the key 37 is inserted and the cylinder core 6 has been turned into the position illustrated in FIG. 9, the switching position exists. In this position the tripping contact cam 7 of the cylinder core 6 also actuates the switching roller 14 of the lever 15, whereby the switch 17 sends a pulse to the solenoid 10. The pawl 9 is pulled and steps into engagement with the recess 8 of the contact cam 7. A reverse rotation of the cylinder core 6 during a (gas) pumping operation then is not possible. Only after conclusion of the pumping operation does the solenoid 10 receive a release pulse, whereupon the pawl 9 leaves the recess 8 of the tripping cam 7.

It would also be possible to provide the electric switching device plus locking cylinder on a door, for example a hotel room door. In this manner a control of entrance can be realized and if necessary the period of occupancy can be monitored.

I claim:

1. In an electric switching device on a rotary cylinder lock having a rotatable core and with core pins which are controlled by a key, the stroke of the core pins bringing contact lugs in contact position relative to a counter-contact surface, the improvement comprising a plurality of counter-contact surfaces being adjacent to each other and formed into a row, at least one transmission lever having a free end forming a contact lug, at least one core pin constituting means for being controlled by the form of the key and for operatively acting on said transmission lever for moving the latter dependent on the extent of control of the core pin by the form of the key, said transmission lever being mounted relative to said row of counter-contact surfaces such that via said core pin which is controlled by the form of the key, said contact lug is slidable over at least a portion of said row of counter-contact surfaces.

2. The device as set forth in claim 1, wherein said transmission lever is mounted relative to said core such that said core pin acts on said transmission lever only in a vicinity of the end of rotation of the rotatable core of the cylinder lock.

3. The device as set forth in claim 1, further comprising a continuous contact surface, said contact lug of said transmission lever has two contacts, one of said contacts faces toward said counter-contact surfaces, the other of said contacts slides over said continuous contact surface.

4. The device as set forth in claim 1, wherein the switching device constitutes means for locking a gasoline pump.

5. The device as set forth in claim 1, wherein said transmission lever is pivotally mounted about an axis spaced from and parallel to the rotatable axis of said rotatable core.

6. The device as set forth in claim 1, wherein said core pin is displaced by the form of the key, said transmission lever is formed with said free end such that said row extends over, and said free end is slidable over, a greater distance than the displacement of said core pin by the form of the key.

7. The device as set forth in claim 6, wherein said transmission lever is pivotally mounted at a portion spaced from said free end.

8. The device as set forth in claim 1, further comprising a plurality of tumbler pins, independent of said core pin, and constituting means cooperating with the key for operatively rotating said core, said core pin constitutes means for moving said transmission lever only when said core has been rotated by a certain amount.

9. In an electric switching device on a rotary cylinder lock having a rotatable core and with core pins which are controlled by a key, the stroke of the core pins bringing contact lugs in contact position relative to a counter-contact surface, the improvement comprising a plurality of counter-contact surfaces being adjacent to each other and formed into a row, a transmission lever having a free end forming a contact lug, a core pin constituting means for being controlled by the key and for operatively acting on said transmission lever, said transmission lever being mounted relative to said row of counter-contact surfaces such that via said core pin said contact lug is slidable over at least a portion of said row of counter-contact surfaces, a continuous contact surface, said contact lug of said transmission lever has two contacts, one of said contacts faces toward said counter-contact surfaces, the other of said contacts slides over said continuous contact surface, a plurality of contact plates spaced from each other defining a gap between adjacent of said contact plates, respectively, a plurality of said core pin, said plurality of counter-contact surfaces constitutes a set of said counter-contact surfaces, a plurality of said sets, each of said sets is disposed in said gap on one of said adjacent of said contact plates, respectively, a plurality of said transmission lever, each of said transmission levers is disposed in said gap between said adjacent of said contact plates, respectively, each of the latter cooperates with one of said plurality of core pins, respectively, and with one of said sets of said counter-contact surfaces, respectively, said contact plates are combined together into a block, said two contacts of each of said transmission levers face in opposite directions on opposite sides of said each transmission levers, respectively.

10. The device as set forth in claim 9, further comprising a plurality of spring means for biasing said transmission levers, respectively, said core pins act on said transmission levers against the biasing of said spring means, respectively, a switch housing holds said rotary cylinder lock with said rotatable core therein and is formed with individual channels, each of said spring means are arranged in said individual channels of said switch housing, respectively.

11. In an electric switching device on a rotary cylinder lock having a rotatable core and with core pins which are controlled by a key, the stroke of the core pins bringing contact lugs in contact position relative to a counter-contact surface, the improvement comprising a plurality of counter-contact surfaces being adjacent to each other and formed into a row, a transmission lever having a free end forming a contact lug, a core pin constituting means for being controlled by the key and for operatively acting on said transmission lever, said transmission lever being mounted relative to said row of counter-contact surfaces such that via said core pin said contact lug is slidable over at least a portion of said row of counter-contact surfaces, a cylinder housing having a housing wall formed with an opening, said core is rotatably mounted in said cylinder housing, core tumbler pins operatively mounted in said core cooperating with said housing and the key for rotating said core in said housing, said core pin is formed as a free (springless) pin disposed in said core and having an end projecting into said cylinder housing projecting into said opening in said housing wall, said opening extends in a peripheral arc in the direction of rotation of said rotatable core in said cylinder housing.

12. The device as set forth in claim 11, wherein said transmission lever has a projecting cam projecting into said opening.

13. The device as set forth in claim 11, wherein said cylinder housing has a flange projecting in one direction, spring biased housing tumbler pins are disposed slidably in said flange and cooperate with said core tumbler pins, respectively, said lug of said transmission lever extends parallel to and adjacent to said flange in a non-rotated position of said core.

14. The device as set forth in claim 13, further comprising spring means for biasing said transmission lever into its position parallel to said adjacent flange.

15. The device as set forth in claim 14, wherein said transmission lever is pivotally mounted on the other end thereof and has a curved portion corresponding to said core between said lug and said other end, said spring means for acting on said curved portion.

16. In an electric switching device on a rotary cylinder lock having a rotatable core and with core pins which are controlled by a key, the stroke of the core pins bringing contact lugs in contact position relative to a counter-contact surface, the improvement comprising a plurality of counter-contact surfaces being adjacent to each other and formed into a row, a transmission lever having a free end forming a contact lug, a core pin constituting means for being controlled by the key and for operatively acting on said transmission lever, said transmission lever being mounted relative to said row of counter-contact surfaces such that via said core pin said contact lug is slidable over at least a portion of said row of counter-contact surfaces, spring means for biasing said transmission lever, said core pin acts on said transmission lever against the biasing of said spring means.

* * * * *